US009169440B2

(12) United States Patent
Carlson

(10) Patent No.: US 9,169,440 B2
(45) Date of Patent: Oct. 27, 2015

(54) METHOD OF USING WASTE HOT ROCK TRANSFER TO THERMALLY CONJOIN DISPARATE CARBONACEOUS-RICH PROCESS STREAMS

(76) Inventor: Joseph W. Carlson, Pleasant Grove, UT (US)

( * ) Notice: Subject to any disclaimer, the term of this patent is extended or adjusted under 35 U.S.C. 154(b) by 811 days.

(21) Appl. No.: 13/492,796

(22) Filed: Jun. 8, 2012

(65) Prior Publication Data

US 2012/0316371 A1 Dec. 13, 2012

Related U.S. Application Data

(60) Provisional application No. 61/494,879, filed on Jun. 8, 2011.

(51) Int. Cl.

| | |
|---|---|
| ***C07C 1/00*** | (2006.01) |
| ***C01G 1/04*** | (2006.01) |
| ***C10G 1/00*** | (2006.01) |
| ***C10B 53/00*** | (2006.01) |
| ***C10G 1/02*** | (2006.01) |
| ***C10B 49/16*** | (2006.01) |
| ***C10B 53/06*** | (2006.01) |
| ***C10B 57/02*** | (2006.01) |

(52) U.S. Cl.
CPC ..... *C10B 53/00* (2013.01); *C10B 49/16* (2013.01); *C10B 53/06* (2013.01); *C10B 57/02* (2013.01); *C10G 1/02* (2013.01)

(58) Field of Classification Search
USPC ..... 585/240, 310; 208/390
See application file for complete search history.

(56) References Cited

U.S. PATENT DOCUMENTS 4,152,245 A * 5/1979 Abdul-Rahman et al. .... 208/409

* cited by examiner

*Primary Examiner* — Thuan D Dang
(74) *Attorney, Agent, or Firm* — Angus C. Fox, III

(57) ABSTRACT

A method of concurrently retorting dissimilar hydrocarbonaceous resource streams comprising at least two rotary kilns arranged in a series and closely coupled in an air-tight continuous process flow configuration so as to create a virtual singular rotary kiln yet having distinct residence times and temperature differentials and material processing zones also having continuous thermal coupling and process efficiency achieved by passing along from the first rotary kiln all of the hot spent inorganic waste materials between and into the at least second rotary kiln to then have other dissimilar hydrocarbonaceous matter added therein and differentially heated until the hot inorganic waste materials are released from the at least the second rotary kiln and the increasing residual waste matter volume generated in the combined serial process is ultimately discharged into a secondary heat recovery system.

12 Claims, 1 Drawing Sheet

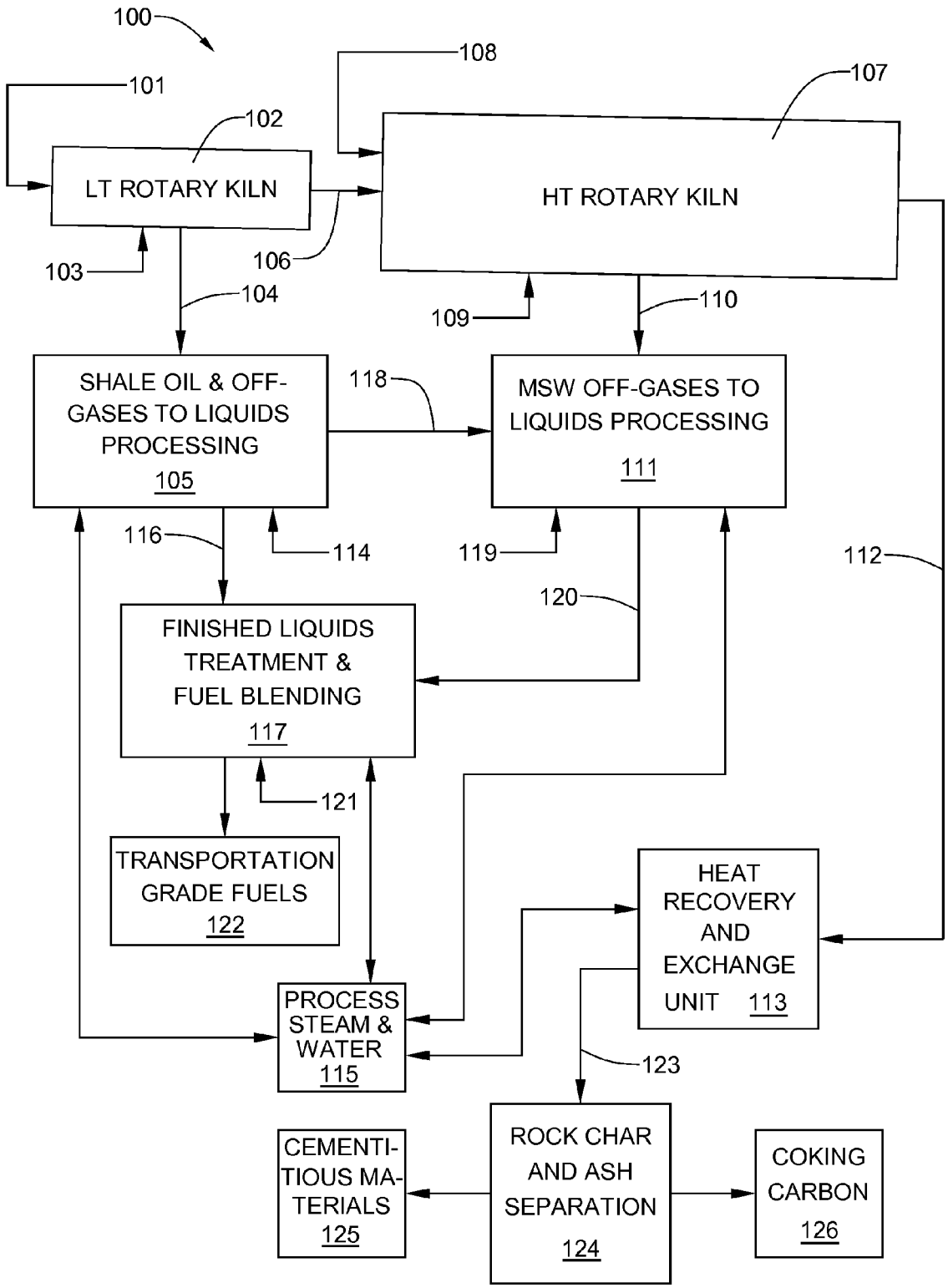
100
101
102
LT ROTARY KILN
103
104
106
108
107
HT ROTARY KILN
109
110
SHALE OIL & OFF-GASES TO LIQUIDS PROCESSING
105
118
MSW OFF-GASES TO LIQUIDS PROCESSING
111
116
114
119
112
120
FINISHED LIQUIDS TREATMENT & FUEL BLENDING
117
121
TRANSPORTATION GRADE FUELS
122
HEAT RECOVERY AND EXCHANGE UNIT 113
PROCESS STEAM & WATER
115
123
CEMENTI-TIOUS MA-TERIALS
125
ROCK CHAR AND ASH SEPARATION
124
COKING CARBON
126

METHOD OF USING WASTE HOT ROCK TRANSFER TO THERMALLY CONJOIN DISPARATE CARBONACEOUS-RICH PROCESS STREAMS

This application has a priority date based on the filing of Provisional Patent Application No. 61/494,879 by the same inventor and of the same title on Jun. 8, 2011.

BACKGROUND OF THE INVENTION

1. Field of the Invention

This invention relates, generally, to retort processes for extracting hydrocarbon fuels from low-value feedstocks, such as oil shale and carbonaceous municipal solid wastes. More particularly, the invention relates to concurrent, thermally-coupled retort extraction processes for disparate feedstocks.

2. Description of Related Art

Various alternative energy production processes, using partial combustion, combustion and/or heat retorting, have been proposed and implemented for releasing, capturing and refining hydrocarbons from low-value carbonaceous feedstocks, such as tar sands, oil sands, oil shale and pulverized municipal sold waste ("MSW"). The recovered hydrocarbons, which are typically in the form of liquids and/or low-carbon-number alkanes, generally require further processing and reforming in order to optimize their utility. As a rule, the processes used to extract hydrocarbon compounds from each of the disparate carbonaceous feedstocks are anaerobic, and utilize unique ranges of temperature and pressure.

For example, to enhance recovery and thwart excess decomposition of hydrocarbons due to over-heating, Dana (U.S. Pat. No. 7,862,705) discloses a method of recovering hydrocarbons from hydrocarbonaceous materials that can include forming a constructed permeability control infrastructure. This constructed infrastructure defines a substantially encapsulated volume. Comminuted hydrocarbonaceous material can be introduced into the control infrastructure to form a permeable body of hydrocarbonaceous material. The permeable body can be heated sufficient to remove hydrocarbons therefrom. During heating, the hydrocarbonaceous material is substantially stationary as the constructed infrastructure is a fixed structure. Specifically, when proto-petroleum-like kerogen laden oil shale is slowly retorted in the encapsulated infrastructure at a lower temperature, higher quality lighter gravity API oil ready for upgrading using hydro-treating is recovered having no fines or bottoms.

Klepper (U.S. Pat. No. 7,655,215) has also shown that lower temperatures and slower process times can be used to capture and process a variety of hydro-carbonaceous material into useful byproducts. Conversely, at very high processing temperatures, incineration and full combustion gasification of the kerogen-based feedstocks takes place. Klepper alternatively discloses an apparatus operating at differing temperatures in different oxygen-free zones designed to form syngas from carbonaceous materials such as coal that includes a devolatilization reactor in combination with a reformer reactor which subsequently forms syngas (a gas mixture that containing varying amounts of carbon monoxide and hydrogen). The reformer reactor, in turn, is in communication with a particulate separator. The devolatilization reactor is fed with material using a compression feeder which drives air from the feed material, compresses it in a feed zone forming a seal between the feed hopper and the devolatilization reactor. The reformer reactor, as well as the particulate separators, is maintained in a heated furnace so that the temperature of the formed syngas does not decrease below the reaction temperature until particulate material has been separated. Klepper pioneered the use of separation of working zones for retorting mixed feedstocks and conveying said heated materials within the system using the disclosed methods.

Clayson ("Combustion of Municipal Solid Wastes with oil Shale in a Circulating Fluidized Bed," Department of Energy Grant No. DE FG01 94CE15612, Jun. 6, 1996, Energy Related Inventions Program Recommendation No. 612, Inventor R. F. Clayson, NIST.) first describes combustion of oilshale with municipal solid waste ("MSW"). Clayson, et. al., disclosed integrated process for the treatment of MSW combined with oil shale. In this process, after recycling steps to save usable materials such as aluminum, other metals, and glass have been completed, the resulting refuse-derived fuel ("RDF") reduced from the MSW was co-combusted with oil shale in a circulating fluidized bed. During combustion, the oil shale not only reportedly removed sulfur dioxides, chlorine compounds, and other pollution effluents, but it also added significant hydrocarbon fuel content and constituents to the overall gasified yield and the waste rock char byproduct also became a useful cementitious ash. Clayson, et. al. claims the possibility of creating an environmentally beneficial and financially viable integrated process in which the RDF helps produce electrical energy, the volume of solid waste is greatly reduced in both volume and weight, and RDF's potentially hazardous components can be encapsulated in a non-hazardous cementitious material that could serve other useful purposes. Accordingly, the authors of the publically funded DOE report assert the integrated process would eliminate the main environmental problems associated with MSW and its associated waste streams.

Enefit (Eesti Energia in Estonia) is the largest oil shale mining and processing company in the world. During more than 50 years of continuous surface retort production, Enefit has produced more than 200 million barrels of oil from oil shale. Enefit's technology employs a dryer, a rotary kiln reactor, and a furnace unit that is used to retort spent oil shale. The resulting hot ash is separated from the combustion gas and mixed with comminuted oil shale feedstock in the rotary kiln reactor. Combustion gases from the furnace unit are used to dry the comminuted oil shale feedstock in the dryer before mixing it with hot ash.

Other related prior art describes various methods relating to the properties of oil shale being heated to various temperatures and injected in various combustion processes. Boardman, et. al. (U.S. Pat. No. 7,384,615 and U.S. Pat. No. 7,708,964) virtually mirrors the findings in the Department of Energy funded Clayson Publication, op. cit., which previously discloses pollution abatement properties of combusting oil shale with MSW. Boardman abstracts the Clayson findings and separately applies the prior art alternatively to coal combustion claiming a method of decreasing pollutants in a thermal conversion process by taking the existence of a concurrent pollution generating process being injected with oil shale for its sorbent and kerogen properties to sequester during combustion any pollutants generated during the thermal conversion process. Specifically, Boardman, et. al., (U.S. Pat. No. 7,384,615) discloses a method of decreasing pollutants produced in a combustion process. The method comprises combusting coal in a combustion chamber to produce at least one pollutant selected from the group consisting of a nitrogen-containing pollutant, sulfuric acid, sulfur trioxide, carbonyl sulifde, carbon disulifde, chlorine, hydroiodic acid, iodine, hydrolfuoric acid, fluorine, hydrobromic acid, bromine, phosphoric acid, phosphorous pentaoxide, elemental mercury, and mercuric chloride. Oil shale particles are introduced into the combustion chamber and are combusted to produce sorbent particulates and a kerogen reductant. The at least one pollutant is contacted with at least one of the sorbent particulates and the kerogen reductant to decrease an amount of the at least one pollutant in the combustion chamber. The kerogen reductant may chemically reduce the at least one pollutant to a benign species. The sorbent particulates may adsorb or absorb the at least one pollutant. A combustion chamber that produces decreased pollutants in a combustion process is also disclosed. Boardman (U.S. Pat. No. 7,708,964) also claims pollution control substances may be formed from the combustion of oil shale, which may produce a kerogen-based pyrolysis gas and shale sorbent, each of which may be used to reduce, absorb, or adsorb pollutants in pollution producing combustion processes, pyrolysis processes, or other reaction processes. Pyrolysis gases produced during the combustion or gasification of oil shale may also be used as a combustion gas or may be processed or otherwise refined to produce synthetic gases and fuels.

Alternatively, Hatfield, et. al. (U.S. Pat. Pub. No. US2008/0202985A1) when used in apparatus and process combination with Coates (U.S. Pat. Pub. No. US2010/0294700A1) carefully controls lower temperatures and processing times to efficiently capture higher quality lighter gravity API oils derived from oil shale using an improved rotary kiln and resulting improved processing methods of the off-take hydrocarbons. Hatfield discloses a continuous, efficient surface method for thermal recovery of hydrocarbons from a solid feedstock which includes a self-contained process that produces hydrogen for upgrading the hydrocarbons to produce motor fuel. The hydrogen also is used as a clean burning fuel for the thermal processing. The hydrogen is produced as a component of synthesis gas formed by gasification of coal. The synthesis gas is processed to remove and dispose of carbon dioxide and by-product sulfur. Combustion of the hydrogen to provide indirect heating of the solid feedstock maximizes hydrocarbons that can be upgraded and reduces or eliminates the emission of carbon dioxide into the atmosphere.

Coates, et. al., (U.S. Pat. Pub. No. US2010/0294700A1) disclosed an apparatus and method, also used in close conjunction with the Hatfield's et. al. efficient surface art (U.S. Pat. Pub. No. US2008/0202985A1), for achieving improved throughput capacity of indirectly heated rotary kilns used to produce pyrolysis products such as shale oils or coal oils that are susceptible to decomposition by high kiln wall temperatures. High throughput is achieved by firing the kiln such that optimum wall temperatures are maintained beginning at the point where the materials enter the heating section of the kiln and extending to the point where the materials leave the heated section. Multiple high velocity burners are arranged such that combustion products directly impact on the area of the kiln wall covered internally by the solid material being heated. Firing rates for the burners are controlled to maintain optimum wall temperatures.

OBJECTS OF THE INVENTION

The present invention was formulated with a number of objects in mind. A first object was to facilitate the exploitation of energy production from large untapped domestic resources, such as oil shale and municipal solid wastes. A second object was to reduce reliance on landfills for municipal waste disposal, as landfills are unwanted by nearby residents, will be largely unusable for generations, and new landfills are competing for increasingly scarce and expensive land that could be put to higher uses. A third object of the invention was to conjoin disparate energy extraction processes at a single optimal location. A fourth object was to utilize waste heat produced in one energy extraction process to enhance the efficiency of at least one other energy extraction process. A fifth object of the invention was to facilitate the use of different and specific working temperatures and recovery rates for disparate hydrocarbon feedstock processes. A sixth object was to enable the processing of greater quantities of low-value, alternative energy, hydrocarbon feedstocks by making disparate fuel recovery methods both economically and process codependent. A seventh object of the invention was to generate useful cementitious byproducts for use in construction and infrastructure projects. Another object of the invention was to increase the production of useful, non-volatile carbonaceous byproducts.

SUMMARY OF THE INVENTION

The present invention builds on the processes of Hatfield and Coates, et al. by serially conjoining at least two indirectly-fired rotary kilns for disparate alternative energy feedstock processing by using spent waste rock char to preheat RDF feedstocks through surface contact and tumbling, thereby more evenly releasing hydrocarbons from such solid feedstocks. Though the invention is disclosed in the context of the concurrent retort processing of oil shale and municipal solid waste (which includes typical landfill materials, as well as sewer treatment plant solids), the invention is also applicable to other concurrent processes. The invention is directed at maximizing the recovery of hydrocarbon compounds from generally low-value, hydrocarbon-containing feedstocks while, at the same time, minimizing the energy input required for the process.

By using separate lower or higher temperature processing in isolated thermal conversion zones in separate rotary kilns that are serially interconnected by transferring the heat absorbed in inorganic matter between the rotating kilns, the present invention does not disrespect the nature and composition of various non-traditional hydro-carbonaceous feedstocks by traditional agglomeration for gasification by incineration. In other words, each feedstock is processed using parameters that are optimum for that feedstock. As such, the present invention allows for specialized temperature differentiation and chemical reforming and efficiently optimizes both the extraction of upstream and downstream processing by conjoining at optimum process flows various disparate processing streams. Because of the complex nature of the various hydro-carbonaceous material found in municipal solid wastes ("MSW") and so called Biomass, gasification is typically selected from an array of processing methods to recover condensate and catalyzed compounds for further processing of such waste-based alternative energy streams. The present invention does not specify combustion, but rather selects rotary kiln retorting of carbonaceous feedstocks in the absence of oxidation. Furthermore, as an antecedent insight to the present useful invention, given the prior art of comingling feedstocks, it was not obvious that MSW (containing approximately 10 million BTUs per ton) and oil shale (typically containing one-third the energy density of MSW measured in BTUs) should be material separated yet linked by a serial process system using differential temperature methods for thermal conversion efficiency enabled by air-tight hot waste char being transferred between the separate yet conjoined rotary kiln processes to better extract by separate retorting the organic materials from the inorganic matter contained in the disparate feedstocks. In fact, quite the exact opposite illustration and converse processing method to the present invention is found in various prior published pyrolysis art. (See "PRODUCTION AND CHARACTERIZATION OF PYROLYSIS LIQUIDS FROM MUNICIPAL SOLID WASTE," by James. E. Helt and Ravindra. K. Agrawal; Argonne National Laboratories, 9700 South Cass Avenue, Argonne Ill. 60439: from White Paper, pp. 82-89 of Part II. Production of Primary Pyrolysis Oils—Fundamentals, DOE.) Specifically, conventional practice in thermally reforming different carbonaceous material is accomplished by combining and agglomerating such unrelated feedstocks as MSW with oil shale into a singular "all-in-one" high temperature partial combustion gasification process—a reported fluidized bed thermal conversion unit. Typical combustion or partial combustion of MSW with oil shale using a traditional fluidized bed system results in the extreme scission and deformation of light kerogen oils found in oil shale that are best preserved and derived from the marlstone at lower temperatures. With the typical complete combustion of all organic matter in the oil shale along with the MSW, the available resulting exhaust off-gases and the complex products of combustion must then be extensively reformed to create alternative energy from the combustion process.

Heat retorting of carbonaceous matter allows for precise heat control and exact processing times while thermally releasing from the feedstock the desired hydrocarbons from the inorganic waste substrates eventually left behind in the thermal conversion unit for removal and disposal. Retorting by heating of carbonaceous feedstock matter in the absence of oxygen has also been developed and used to prevent complete combustion and other undesirable reduction reactions from happening to the carbonaceous feedstock matter. In addition, use of oxygen to combust or partially combust carbonaceous feedstock matter such as found in MSW has become a disqualified chemical process as to whether such alternative energy production processes using oxygen for reduction qualifies for present-day green-energy classification and acceptable renewable energy generation supported by state and federal environmental quality regulations. (See California Energy Commission, "Renewable Energy Program Portfolio—Standard Eligibility Guidebook," December 2007, CEC-300-2007-006-ED3-CTD.)

To optimize these disparate retorting processes, the present invention discloses an enclosed serial anaerobic system where hot waste rock char discharge is transferred between a first, lower temperature, indirect-fired rotary kiln into at least a second rotary kiln to directly augment the preheating of added RDF feedstocks then processed at a higher temperature in the second rotary indirect-fired kiln. The transfer of hot waste rock char from one rotary kiln to another preserves heat energy that would otherwise be lost.

The present invention is clearly distinguishable from the heretofore cited prior art, is neither anticipated nor obviated thereby, and provides a significant increase in efficiency with respect thereto. As opposed to Dana's passive quasi-in-situ method in a fixed capsule with no material manipulation and approximate thermodynamics and material heating control, the present invention is an active moving and manipulated process that transfers heated waste rock char between indirect fired rotary kilns having precise process speed and temperature control. Greater yields of hydrocarbons from feedstocks are achieved in the present invention by specialization of processes combined with heating, transfer and superheating of spent waste rock chars in the presence of separately processed hydrocarbonaceous material. In comparison with the process of Klepper, the present invention teaches the use of serial rotary kilns, for the processing of different feedstocks, which are conjoined by the transfer of hot waste material to achieve thermal conservation. In addition, the process of the present invention is the converse of that of Clayson, et. al. The present invention specifies physical separation of thermal processing of oil shale and thermal processing of MSW for technical and economic reasons, as well as not combusting oil shale and MSW in the same thermal conversion unit. In addition, the present invention combines the economic benefits of combining oil shale energy recovery processing with MSW energy recovery processing but does not combine the separate energy recovery processing of oil shale and MSW into a single processing method using destructive combustion. Anathema to Clayson, et al., the present invention specifically discloses separating feedstocks and bifurcated production specialization and precision processing methods tailored to the unique feedstock hydrocarbons to be processed by conjoining said separate retorting processes by continuously sharing waste rock char material transferred through to at least a second retorting processes rather than a gross combined feedstock processing method producing complex composite waste gases from combustion requiring extensive reforming of said products of combustion into alternative fuel liquids. Boardman, et al., on the other hand, does not teach the present invention's method of thermally conjoining at least two separately-controlled, temperature-dependent and process-time-dependent, serially-arranged rotary retort kilns, which utilize air-tight pass-through of hot waste char for preheating of additional organic matter awaiting higher-heat thermal processing for extraction of useful byproducts there from for further dependent thermal processes downstream, thereby conserving heat energy that would ordinarily be lost. In the present invention, the first rotary kiln is charged with oil shale where the waste rock char is charged into at least a second higher-heat rotary kiln where RDF is added and processed. Furthermore, unlike Enefit's widely advertised oil shale processing technology, the present invention does not recirculate hot spent waste rock char back into the ready input stream of un-retorted oil shale feedstock in order to preheat that feedstock for downstream thermal processing. The Enefit method of preheating the new oil shale with previously spent hot waste rock char would defeat the purpose and method of the present invention having the alternative specification to preheat a second different and separate feedstock of hydrocarbonaceous matter to be retorted downstream at a much higher temperatures.

The present invention provides numerous advantages over the prior art. A first advantage is the availability of new options and alternative for jointly processing large volumes of largely-untapped, disparate energy resources into transportation grade fuels. A second advantage is the potential to reduce reliance on landfills for the storing of municipal solid wastes, which may constitute a health and/or environmental hazard for generations, or even millenia. A third major advantage is the conversion of municipal solid waste (MSW) into useful hydrocarbon fuels. A fourth advantage is subsidization of transport of MSW feedstocks to a central processing location. As transportion and disposal of MSWs are prepaid by municipal residents and businesses, the transportion of such wastes to a processing site located at an oil shale processing site may actually be less expensive than burying it in a landfill. Such a scenario may bode well for capital investment in such processes. A fifth advantage is the conservation of energy by employing heat energy generated in one process for a subsequent and conjoined second process. A sixth advantage of the invention is that it allows for physically separate and precisely-controlled temperature settings and processing times to be tailored to a particular thermal processing method without incineration of the alternative energy feedstock to achieve optimum products in the energy extraction process. A seventh advantage is that by combining the processing of MSW, which has relatively high thermal content with the processing of a more dense resource, such as oil shale, which has relatively low thermal content, can double, or even triple total recoverable BTU output yields at lower averaged costs. An eighth advantage of the invention is that it can provide an inexpensive source of construction-grade cementitious raw materials on a large scale for US infrastructure reconstruction. Thus, the invention could potentially create a strategic repository of construction-grade cementitious material that can either be returned to the mining operation as finished goods inventory, treated as backfill, or stockpiled at separate secure locations. A final advantage of the present invention is that can potentially provide an inexpensive source of raw materials on a large scale for coking carbons for steel making and other useful purposes.

BRIEF DESCRIPTION OF THE DRAWING

FIG. 1 is a diagramatic process flow of a presently preferred embodiment of the invention.

DETAILED DESCRIPTION OF THE INVENTION

The present invention allows for a unique combination of optimum economic practices with and optimum technical practices for alternative energy production derived from disparate hydrocarbonaceous feedstocks requiring differential thermal processing. Specifically, the present invention tackles the joint processing and extraction of hydrocarbon fuel stocks from municipal solid waste (MSW) and oil shale. This is accomplished by serialized processing of the feedstocks, coupled with the transfer of heat contained in waste materials between serialized processes to assist with a resulting parallel processing of the off-take products derived from the serialized feedstock reducing steps.

From a first separate lower heat-requirement alternative energy recovery process for retorting oil shale, a continuous pre-specified comminuted stream of hot pre-calcinated waste rock char is removed as a waste stream from a first indirect-fired rotary retort kiln that is incorporated into the first separate lower heat-requirement alternative energy recovery process for retorting oil shale, whereupon the hot waste rock char is not in whole or in part recirculated back into the first kiln but fully and immediately air-tight injected into at least a second indirect-fired rotary retort kiln that is incorporated into a second separate higher heat-requirement alternative energy recovery process wherein the hot pre-calcinated waste rock char is proportionally injected with a continuous feedstock of pulverized carbonaceous municipal mixed solid wastes there to more efficiently pre-heat and mix the carbonaceous wastes in the second indirect-fired rotary kiln wherein the pre-heated mixture of waste and char is immediately infused with additional indirect higher process heat to both fully gasify the municipal mixed solid waste streams for gaseous downstream delivery into the second separate higher heat-based alternative energy recovery process and concurrently fully calcinate and then separate the hot waste rock char and residual carbon and ash from the gasified matter presently released for separate downstream processing. Prior to dispensing of the calcinated waste rock char and additional residual carbon and ash derived from the pulverized carbonaceous municipal mixed solid wastes discharged from the second indirect-fired rotary kiln into an array of disposal choices being selected from landfill, coking carbon, sorbent material and cementitious byproducts, heat exchangers and heat recovery methods are then applied to recover thermal energy stored in the previously differentially-heated waste rock char to help recapture waste heat from the calcinated waste rock char to efficiently sustain other downstream more heat-dependent processing incorporated in the first and second alternative energy recovery processes.

Referring now to FIG. 1, the process 100 is shown in diagrammatic format, whereby at least two, serially-conjoined, indirectly-fired rotary kilns are employed for disparate alternative energy feedstock processing, using spent waste rock char to preheat RDF feedstocks through surface contact and tumbling. A first feedstock of comminuted oil shale 101 is continuously fed into a lower-temperature rotary retort kiln 102 under anaerobic conditions (i.e., in the absence of oxygen). The lower temperature rotary retort kiln 102 and the generalized shale oil and off-gases to liquids processing system 105 together comprise the lower-temperature train of equipment and systems to process oil shale into transportation grade fuels and whereas the higher-temperature rotary retort kiln 107 and the generalized RDF-MSW off-gases to liquids processing system 111 together comprise the higher-temperature train of equipment and systems to process RDF into transportation grade fuels. Not shown within the generalized shale oil and off-gases to liquids processing system 105 are combined processes selected from an array of condensers, water recovery systems, hydrotreaters and hydrocrackers that would comprise a typical plurality of equipment and systems included in the well known art of oil shale refining. Not shown within the generalized RDF-MSW off-gases to liquids processing system 111 are combined processes selected from an array of shift reactors, gas clean-up systems, catalytic systems and Fischer-Tropsch-like gas-to-liquid processing systems that would comprise a typical plurality of equipment and systems included in the known art of pyrolysis derived syngas to liquids refining. As such, the shale oil and off-gases to liquids processing system 105 and the RDF-MSW off-gases to liquids processing system 111 are useful prior art integrated with the present invention. As such, the present invention incorporates the generalized off-gases to liquids processing systems 105 and 111 in a more economical, improved parallel configuration.

The key elements of new art of the present invention shown in FIG. 1 comprise the lower temperature rotary retort kiln 102, the thermally conjoined higher temperature rotary retort kiln 107 and the hot waste rock char 106 being extracted from the lower temperature rotary retort kiln 102 and injected downstream using an air-tight channel into the higher temperature rotary retort kiln 107.

As shown in FIG. 1 and as clearly understood by one having ordinary skill in the art of hydrocarbon processing and refining, the separate lower-temperature train of equipment, comprising the lower-temperature rotary retort kiln 102 and the generalized shale oil and off-gases to liquids processing system 105, is thermally linked to the higher-temperature train of equipment, comprising the higher-temperature rotary retort kiln 107 and the generalized RDF-MSW off-gases to liquids processing system 111, by the thermal process flow of the hot waste rock char 106 from the lower-temperature rotary retort kiln 102 to the higher-temperature rotary retort kiln 107.

Combining all of the elements in FIG. 1 describes a useful process that illustrates one preferred embodiment of the present invention. Therefore, commencing with feedstock flows, a continuous feedstock of oil shale 101 is charged into a lower-temperature rotary retort kiln 102 using added kiln heat 103. Two resultant continuous process flows are generated, which include product-based shale oil and oil shale off-gases 104 and feedstock-based inorganic hot waste rock char 106. The hot waste rock char 106 is conveyed as waste through an air-tight channel into at least a second higher-temperature rotary retort kiln 107 where a feedstock of RDF-MSW 108 is added and comes in thermal contact with the hot waste rock char 106 and commences to preheat the RDF-MSW 108 for retorting where with higher kiln heat 109 is added and combined into at least a second higher-temperature rotary retort kiln 107 thereafter producing two resultant continuous process flows of product-based RDF-MSW off-gases 110 and combined feedstock-based carbon waste fines and hot rock char 112. Continuing with feedstock flows, the super-heated carbon waste fines and hot rock char 112 are discharged into at least one heat recovery and exchange system 113 where useful BTUs from the expended upstream kiln heat 103 and added higher kiln heat 109 are continuously recovered and thermally exchanged and bi-directionally distributed downstream as process steam and process water 115 to and from the shale oil and off-gases to liquids processing system 105 and the RDF-MSW off-gases to liquids processing system 111 and the generalized finished liquids treatment and fuel blending system 117 wherein the system 117 combined processes are selected from an array of heaters and condensers that would comprise a typical plurality of equipment and systems included in the well known art of polished fuels refining and blending. Concurrently to exchanging heat and producing process steam in the heat recovery and exchange system 113, the thermally-depleted carbon waste fines and hot rock char 123 are passed to the rock char and ash separation system 124 where traditional density-based pneumatics are used to separate the thermally-depleted carbon waste fines and rock char 123 into valuable cementitious material 125 and carbon fines used in, i.e., coking carbon 126. Continuing with product flows, from the lower-temperature rotary retort kiln 102, shale oil and oil shale off-gases 104 are passed into the shale oil and off-gases to liquids processing system 105 where process heat 114 is added and process steam and process water 115 are added or extracted to and from the heat recovery and exchange system 113 to aid in downstream processing. From the shale oil and off-gases to liquids processing system 105, two continuous resultant product flows of oil shale off-gases 118 and semi-polished liquid fuel components 116 are produced. Oil shale off-gases 118 are passed to the RDF-MSW off-gases to liquids processing system 111 and continuously combined with RDF-MSW off-gases 110 where process heat 119 is added and process steam and process water 115 are also added or extracted to and from the heat recovery and exchange system 113 to aid in downstream processing. From the RDF-MSW off-gases to liquids processing system 111, a resultant continuous process product flow of syngas-based semi-polished liquid fuel components 120 are produced and passed to the finished liquids treatment and fuel blending system 117. Semi-polished liquid fuel components 116 are also passed into the finished liquids treatment and fuel blending system 117 where process heat 121 is added and process steam and process water 115 are also added or extracted to and from the heat recovery and exchange system 113 to aid in downstream processing. Finally, from the finished liquids treatment and fuel blending system 117, polished transportation grade fuels 122 are ultimately produced by the objectives and advantages of the present invention.

Although only several embodiments of the invention have been shown and described, it will be obvious to those having ordinary skill in the art that changes and modifications may be made thereto without departing from the scope and the spirit of the invention.

What is claimed is:

1. A thermally-conjoined process for extracting hydrocarbon compounds from two disparate feedstocks processed separately, said process comprising the steps of:

retorting a comminuted first feedstock comprising sedimentary rock, infused with hydrocarbon compounds, in a first rotary retort kiln, thereby vaporizing the hydrocarbon compounds from the sedimentary rock, the latter being converted to inorganic hot waste rock char;

extracting the vaporized hydrocarbon compounds from said first rotary retort kiln;

condensing the extracted vaporized hydrocarbon compounds for subsequent processing;

transferring at least a portion of the hot waste rock char to a second rotary retort kiln, where it is used to preheat a second feedstock containing organic materials;

retorting said second feedstock by applying additional heat to said second rotary retort kiln in order to gasify said organic materials;

extracting the gasified organic materials from said second rotary retort kiln; and condensing the extracted gasified organic materials for subsequent processing.

2. The thermally-conjoined process of claim 1, wherein said first feedstock is retorted using optimum processing parameters.

3. The thermally-conjoined process of claim 1, wherein said second feedstock is retorted using optimum processing parameters.

4. The thermally-conjoined process of claim 1, wherein both said first and second feedstocks are retorted in anaerobic conditions.

5. The thermally-conjoined process of claim 1, wherein said first feedstock is continuously fed into said first rotary retort kiln, said vaporized hydrocarbon compounds are continuously extracted from said first rotary retort kiln, said hot waste rock char is continuously removed from said first rotary retort kiln and transferred to said second rotary retort kiln, said second feedstock is continuously fed into said second rotary retort kiln, and said gasified organic materials are continuously extracted from said second rotary retort kiln.

6. The thermally-conjoined process of claim 1, wherein carbon waste fines and hot rock char are continuously removed from said second rotary retort kiln.

7. The thermally-conjoined process of claim 6, wherein heat is continuously recovered from said carbon waste fines and hot rock char removed from said second rotary retort kiln, said recovered heat being used to generate process steam used in the further processing of condensed hydrocarbon compounds and condensed organic materials.

8. The thermally-conjoined process of claim 1, wherein the hot waste rock char is intimately mixed with said second feedstock.

9. A thermally-conjoined process for extracting hydrocarbon compounds from oil shale and converting municipal solid waste into recoverable carbonaceous gases and carbon waste fines, said process comprising the steps of:

retorting a comminuted oil shale feedstock in a first rotary retort kiln, thereby vaporizing the hydrocarbon compounds contained in the oil shale and converting a remaining inorganic portion into hot waste rock char;

extracting the vaporized hydrocarbon compounds from said first rotary retort kiln;

condensing the extracted vaporized hydrocarbon compounds for subsequent processing;

transferring at least a portion of the hot waste rock char to a second rotary retort kiln, where it is used to preheat a municipal solid waste (MSW) feedstock containing organic materials;

retorting the MSW feedstock by applying additional heat to said second rotary retort kiln in order to gasify said organic materials;

extracting the gasified organic materials from said second rotary retort kiln; and condensing the extracted gasified organic materials for subsequent processing.

10. The thermally-conjoined process of claim 9, wherein each feedstock is retorted using processing parameters optimized for each feedstock.

11. The thermally-conjoined process of claim 9, wherein each feedstock is treated in a continuous process flow, and is subjected to separate and distinct kiln resident times, temperature regimens and processing zones as each feedstock flows through its respective retort kiln.

12. The thermally-conjoined process of claim 9, wherein the hot waste rock char is intimately mixed with the MSW feedstock.

* * * * *